US008052384B2

(12) United States Patent
Blewett et al.

(10) Patent No.: US 8,052,384 B2
(45) Date of Patent: Nov. 8, 2011

(54) CENTRIFUGAL PUMP WITH SEGMENTED DIFFUSER

(75) Inventors: Michael R. Blewett, Stillman Valley, IL (US); Adrian L. Stoicescu, Roscoe, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 813 days.

(21) Appl. No.: 12/140,426

(22) Filed: Jun. 17, 2008

(65) Prior Publication Data

US 2009/0311095 A1 Dec. 17, 2009

(51) Int. Cl.
*F04D 29/62* (2006.01)

(52) U.S. Cl. ..... 415/208.2; 415/209.3; 415/211.2

(58) Field of Classification Search ..... 415/208.2, 415/209.3, 211.2
See application file for complete search history.

(56) References Cited

U.S. PATENT DOCUMENTS

2009/0311095 A1* 12/2009 Blewett et al. ..... 415/209.2

FOREIGN PATENT DOCUMENTS

EP 2136084 A2 * 12/2009

* cited by examiner

*Primary Examiner* — George Fourson, III
(74) *Attorney, Agent, or Firm* — Stephen G. Mican

(57) ABSTRACT

A centrifugal pump with a volute and at least one stage with an associated impeller and removable diffuser assembly comprises: multiple diffuser segments, each diffuser segment comprising a central passage from an inner curvilinear surface to an outer curvilinear surface and a curvilinear leading engagement surface between a leading end of its curvilinear inner surface and its curvilinear outer surface; multiple curvilinear volute mounting surfaces within the volute, each curvilinear mounting surface receiving a corresponding diffuser segment to mount the diffuser segments in a generally annular pattern about the impeller to form the removable diffuser assembly, with the curvilinear inner surface of each diffuser segment proximate an outer periphery of the impeller and the curvilinear leading engagement surface of each diffuser segment engaging a trailing portion of the curvilinear outer surface of an adjacent one of the diffuser segments; and a volute connecting passage within the volute for coupling the central passages of each diffuser segment to a pump outlet.

19 Claims, 3 Drawing Sheets

CENTRIFUGAL PUMP WITH SEGMENTED DIFFUSER

GOVERNMENT RIGHTS STATEMENT

The development of this invention involved government support under N00019-04-C-0093 awarded by (identify the Federal agency). The government has certain rights in the invention.

FIELD OF THE INVENTION

The invention relates to a pump of centrifugal design, and more particularly to a centrifugal pump with at least one impeller flow diffuser.

BACKGROUND OF THE INVENTION

A centrifugal pump for a fluid converts pump input power to kinetic energy in the fluid by means of a revolving device such as an impeller that accelerates the fluid. The most common type of centrifugal pump is the volute pump. Fluid enters the pump through the eye of the impeller and the impeller rotates at high speed. The impeller accelerates the fluid radially outward toward the pump volute or casing. This acceleration of the fluid creates suction at the impeller's eye that continuously draws more fluid into the pump.

The energy that the pump transfers to the fluid is kinetic energy, and is proportional to the velocity at the edge or vane tip of the impeller. The faster that the impeller revolves or the bigger the impeller is, the higher will be the velocity of the energy transferred to the fluid. The purpose of the pump volute or casing is to recover and convert this kinetic energy back to static pressure that a downstream system may more efficiently use. A pump of the centrifugal type may have an annular diffuser that circumscribes its impeller to help diffuse the high velocity discharge of the fluid at the impeller edge and thereby increase conversion of kinetic energy to static pressure. The annular diffuser accomplishes this diffusion with multiple diffuser passageways that extend at an angle from the impeller edge toward the volute and have an area that expands with distance from the impeller edge.

Installation of such an annular diffuser requires that the pump volute have a large diameter split line to install the annular diffuser. This results in a larger diameter volute with increased bulk and weight. Furthermore, the solid ring annular diffuser requires elaborate sealing and venting elements to eliminate leakage and axial loading.

SUMMARY OF THE INVENTION

The invention generally comprises a centrifugal pump with a volute and at least one stage with an associated impeller and removable diffuser assembly comprising: multiple diffuser segments, each diffuser segment comprising a central passage from a curvilinear inner surface to a curvilinear outer surface and a curvilinear leading engagement surface between a leading end of its curvilinear inner surface and its curvilinear outer surface; multiple curvilinear volute mounting surfaces within the volute, each curvilinear mounting surface receiving a corresponding diffuser segment to mount the diffuser segments in a generally annular pattern about the impeller to form the removable diffuser assembly, with the curvilinear inner surface of each diffuser segment proximate an outer periphery of the impeller and the curvilinear leading engagement surface of each diffuser segment engaging a trailing portion of the curvilinear outer surface of an adjacent one of the diffuser segments; and a volute connecting passage within the volute for coupling the central passages of each diffuser segment to a pump outlet.

DETAILED DESCRIPTION OF THE INVENTION

Figure 1:
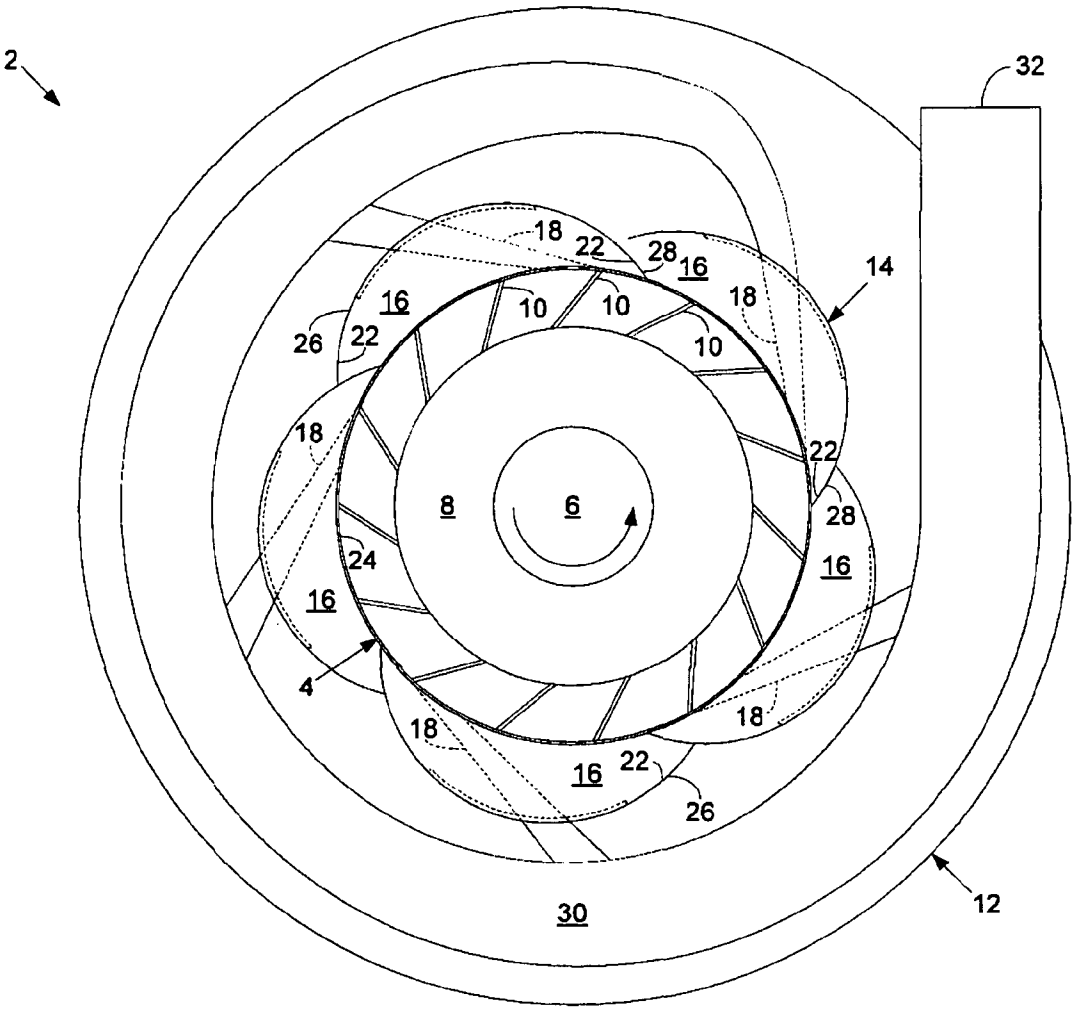
FIG. 1 is a cut-away end view of a centrifugal pump according to a possible embodiment of the invention.
Figure 2:
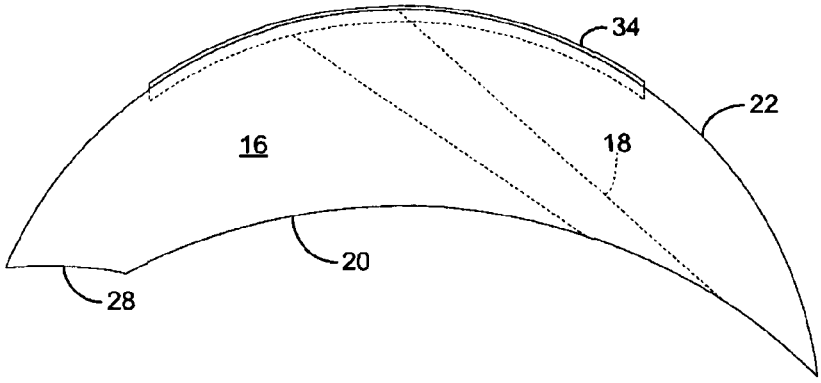
FIG. 2 is a side view of a diffuser segment according to a possible embodiment of the invention.
Figure 3:
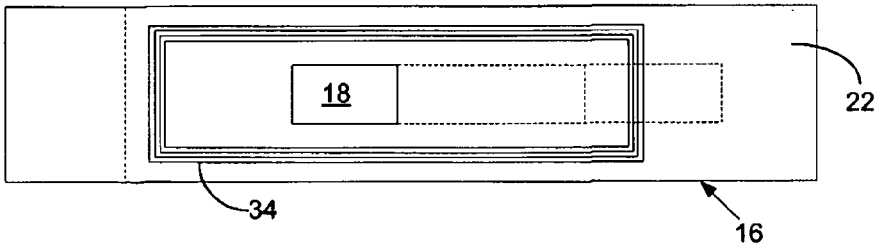
FIG. 3 is a top view of a diffuser segment according to a possible embodiment of the invention.
Figure 4:
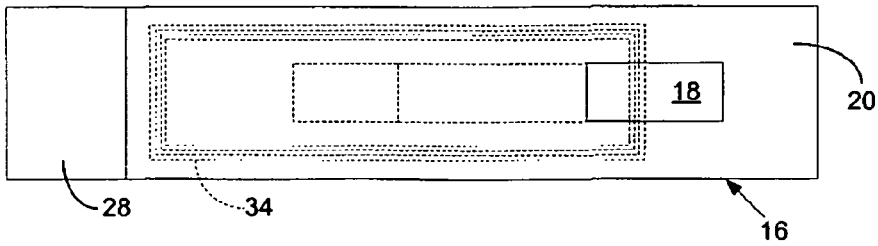
FIG. 4 is a bottom view of a diffuser segment according to a possible embodiment of the invention.

FIG. 1 is a cut-away end view of a centrifugal pump 2 according to a possible embodiment of the invention. The pump 2 has an impeller 4 coupled to a drive shaft 6. The impeller 4 receives fluid in its eye 8 from a pump inlet (not shown). A source of power (not shown) spins the impeller 4 counter clockwise to let multiple impeller vanes 10 impart kinetic energy to the fluid in a generally radial direction. A pump volute 12 receives the energised fluid and converts at least a portion of its kinetic energy to static pressure.

To control the developed pressure of the fluid in the pump 2, the volute 12 mounts a generally annular diffuser assembly 14 that comprises multiple diffuser segments 16. By way of example only, FIG. 1 shows five of the diffuser segments 16 within the volute 12. Referring to FIGS. 1 through 4 together, each diffuser segment 16 has a central passage 18, preferably of generally expanding area, from an inner curvilinear surface 20 to an outer curvilinear surface 22. The inner curvilinear surface 20 of each diffuser segment 16 is generally concave to sit in close proximity to a generally circular outer periphery 24 of the impeller 4. The outer curvilinear surface 22 of each diffuser segment 16 is generally convex to mate with a corresponding one of multiple curvilinear volute mounting surfaces 26 within the volute 12. Each curvilinear volute mounting surface 26 is generally convex to establish a close fit with its corresponding diffuser segment 16.

Each diffuser segment 16 has a curvilinear leading engagement surface 28 between a leading end of its inner curvilinear surface 20 and its outer curvilinear surface 22. The curvilinear leading engagement surface 28 of each diffuser segment 16 is generally concave to mate with and engage a trailing portion of the outer curvilinear surface 22 of an adjacent diffuser segment 16.

Figure 5:
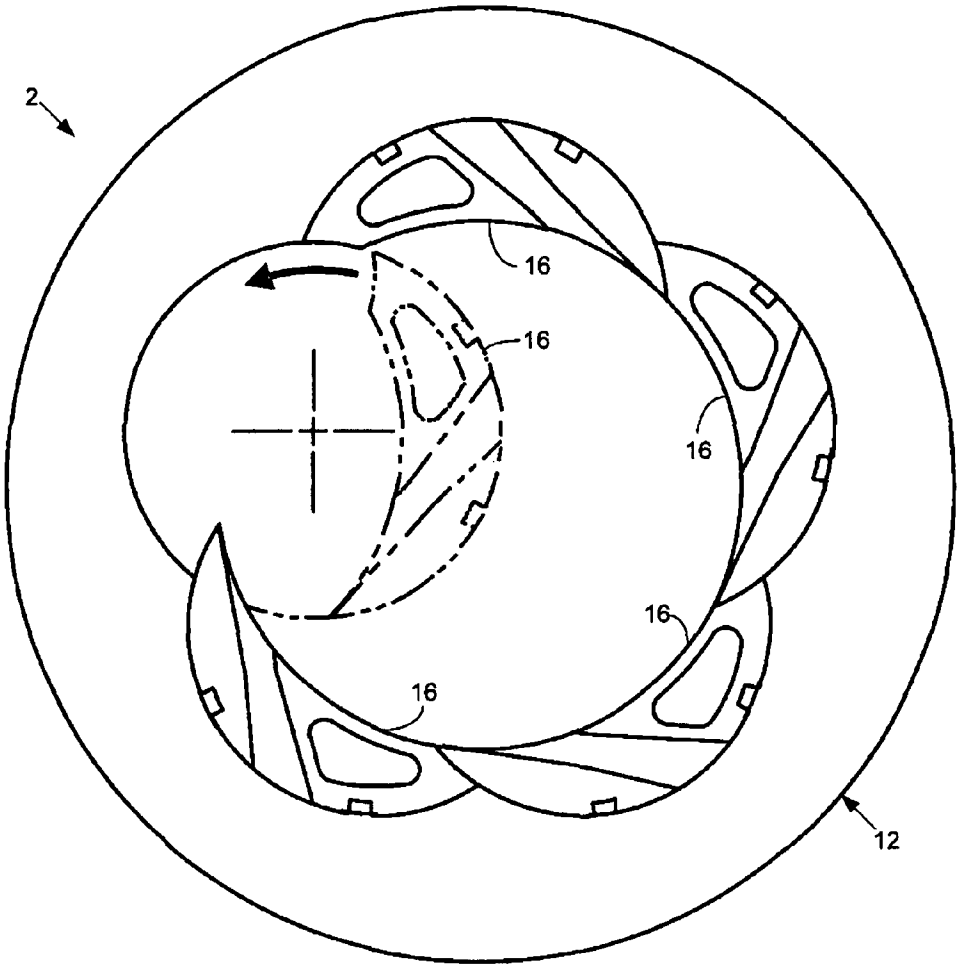
FIG. 5 is a simplified cut-away end view of the centrifugal pump shown in FIG. 1 that illustrates the installation of its diffuser segments.

The diffuser segments 16 freely and individually mount and dismount radially through an impeller bore or cavity occupied by the impeller 4 in a generally annular or ring-like manner about the impeller 4 to form the diffuser assembly 14. FIG. 5 is a simplified cut-away end view of the centrifugal pump 2 shown in FIG. 1 that illustrates the installation of its diffuser segments 16. Assembly requires a rotation of the last mounted diffuser segment 16 into position as shown in FIG. 5. Likewise, disassembly requires rotation of the first removed diffuser segment 16 opposite that shown in FIG. 5. The central passage 18 of each diffuser segment 16 has an couples to a volute connecting core or passage 30 to discharge its fluid to a pump outlet 32. The volute connecting passage 30 preferably has a generally expanding area to the pump outlet 32. The outer curvilinear surface 22 of each diffuser segment 16 preferably has an elastomeric gasket 34 surrounding the discharge from the central passage 18. The elastomeric gasket 34 insures that the higher pressure fluid discharged from its central passage 18 does not leak back around its corresponding diffuser segment 16 to the inlet of its central passage 18. The higher static pressure at the outlet of each central passage 18 forces the curvilinear leading engagement surface 28 of each diffuser segment 16 inward to firmly engage a trailing portion of the outer curvilinear surface 22, thereby firmly constraining the diffuser segments 16 and limiting their relative motion.

Although FIG. 1 shows a single stage of the centrifugal pump 2, the centrifugal pump 2 may have multiple stages with the diffuser assembly 14 mounted within each stage as hereinbefore described. The described embodiment of the invention is only an illustrative implementation of the invention wherein changes and substitutions of the various parts and arrangement thereof are within the scope of the invention as set forth in the attached claims.

The claimed invention is:

1. A centrifugal pump with a volute and at least one stage with an associated impeller and removable diffuser assembly, comprising:

multiple diffuser segments, each diffuser segment comprising a central passage from a curvilinear inner surface to a curvilinear outer surface and a curvilinear leading engagement surface between a leading end of its curvilinear inner surface and its curvilinear outer surface;

multiple curvilinear volute mounting surfaces within the volute, each curvilinear mounting surface receiving a corresponding diffuser segment to mount the diffuser segments in a generally annular pattern about the impeller to form the removable diffuser assembly, with the curvilinear inner surface of each diffuser segment proximate an outer periphery of the impeller and the curvilinear leading engagement surface of each diffuser segment engaging a trailing portion of the outer curvilinear surface of an adjacent one of the diffuser segments; and a volute connecting passage within the volute for coupling the central passages of each diffuser segment to a pump outlet.

2. The pump of claim 1, wherein the curvilinear inner surface of each diffuser segment is generally convex to sit proximate the periphery of the impeller.

3. The pump of claim 1, wherein the curvilinear outer surface of each diffuser segment is generally convex and its corresponding curvilinear volute mounting surface is generally concave to receive the curvilinear outer surface.

4. The pump of claim 1, wherein the curvilinear leading engagement surface of each diffuser segment is generally concave to mate with the trailing portion of the curvilinear outer surface of its adjacent one of the diffuser segments.

5. The pump of claim 1, wherein the central passage of each diffuser element has a generally expanding area from its curvilinear inner surface to its curvilinear outer surface.

6. The pump of claim 1, wherein the curvilinear outer surface of each diffuser segment has an elastomeric gasket surrounding its central passage to insure that the fluid from its central passage does not leak from the interface between the curvilinear outer surface and its corresponding curvilinear volute mounting surface.

7. The pump of claim 1, wherein the diffuser segments freely and individually mount and dismount axially within the volute.

8. The pump of claim 1, wherein the volute connecting passage has a generally expanding area to the pump outlet.

9. The pump of claim 1, wherein the pump comprises multiple stages, each with a diffuser assembly that comprises the diffuser segments.

10. A centrifugal pump with a volute and at least one stage with an associated impeller and removable diffuser assembly, comprising:

multiple diffuser segments, each diffuser segment comprising a central passage from a concave inner surface to a convex outer surface and a concave leading engagement surface between a leading end of its concave inner surface and its concave outer surface;

multiple concave volute mounting surfaces within the volute, each concave mounting surface receiving a corresponding diffuser segment to mount the diffuser segments in a generally annular pattern about the impeller to form the removable diffuser assembly, with the concave inner surface of each diffuser segment proximate an outer periphery of the impeller and the concave leading engagement surface of each diffuser segment engaging a trailing portion of the convex outer surface of an adjacent one of the diffuser segments; and a volute connecting passage within the volute for coupling the central passages of each diffuser segment to a pump outlet.

11. The pump of claim 10, wherein the central passage of each diffuser element has a generally expanding area from its concave inner surface to its convex outer surface.

12. The pump of claim 10, wherein the convex outer surface of each diffuser segment has an elastomeric gasket surrounding its central passage to insure that the fluid from its central passage does not leak from the interface between the convex outer surface and its corresponding concave volute mounting surface.

13. The pump of claim 10, wherein the diffuser segments freely and individually mount and dismount axially within the volute.

14. The pump of claim 10, wherein the volute connecting passage has a generally expanding area to the pump outlet.

15. The pump of claim 10, wherein the pump comprises multiple stages, each with a diffuser assembly that comprises the diffuser segments.

16. A centrifugal pump with a volute and at least one stage with an associated impeller and removable diffuser assembly, comprising:

multiple diffuser segments, each diffuser segment comprising a central passage with a generally expanding area from an concave inner surface to an convex outer surface and a concave leading engagement surface between a leading end of its concave inner surface and its concave outer surface;

multiple concave volute mounting surfaces within the volute, each concave mounting surface receiving a corresponding diffuser segment to mount the diffuser segments in a generally annular pattern about the impeller, wherein the diffuser segments freely and individually mount and dismount axially within the volute to form the removable diffuser assembly, with the concave inner surface of each diffuser segment proximate an outer periphery of the impeller and the concave leading engagement surface of each diffuser segment engaging a trailing portion of the convex outer surface of an adjacent one of the diffuser segments; and a volute connecting passage within the volute for coupling the central passages of each diffuser segment to a pump outlet.

17. The pump of claim 16, wherein the convex outer surface of each diffuser segment has an elastomeric gasket surrounding its central passage to insure that the fluid from its central passage does not leak from the interface between the convex outer surface and its corresponding concave volute mounting surface.

18. The pump of claim 16, wherein the volute connecting passage has a generally expanding area to the pump outlet.

19. The pump of claim 16, wherein the pump comprises multiple stages, each with a diffuser assembly that comprises the diffuser segments.

* * * * *